US005980332A

United States Patent [19]

Tsuji et al.

[11] Patent Number: 5,980,332

[45] Date of Patent: Nov. 9, 1999

[54] ELECTRICAL CONNECTOR

[75] Inventors: Masanori Tsuji; Haruki Yoshida, both of Shizuoka-ken, Japan

[73] Assignee: Yazaki Corporation, Tokyo, Japan

[21] Appl. No.: 08/984,153

[22] Filed: Dec. 3, 1997

[30] Foreign Application Priority Data

Dec. 5, 1996 [JP] Japan ..... P 8-325294

[51] Int. Cl.[6] ..... H01R 13/514

[52] U.S. Cl. ..... 439/752; 439/346

[58] Field of Search ..... 439/346, 752

[56] References Cited

U.S. PATENT DOCUMENTS

| | | | |
|---|---|---|---|
| 4,921,437 | 5/1990 | Cooper et al. | 439/275 |
| 5,257,944 | 11/1993 | Kennedy | 439/347 |
| 5,425,653 | 6/1995 | Koiso | 439/347 |
| 5,435,742 | 7/1995 | Cecil, Jr. | 439/347 |
| 5,591,051 | 1/1997 | Ittah | 439/752 |
| 5,637,009 | 6/1997 | Tsuji et al. | 439/347 |
| 5,647,774 | 7/1997 | Yamamoto | 439/752 |
| 5,722,857 | 3/1998 | Saito et al. | 439/595 |
| 5,769,664 | 6/1998 | Saito et al. | 439/595 |

FOREIGN PATENT DOCUMENTS

| | | |
|---|---|---|
| 0 164 835 A1 | 12/1985 | European Pat. Off. . |
| 3-29276 | 2/1991 | Japan . |
| 4-137474 | 5/1992 | Japan . |
| 7-30468 | 6/1995 | Japan . |
| 2270592 | 3/1994 | United Kingdom . |
| 2280316 | 1/1995 | United Kingdom . |
| 9725646 | 6/1998 | United Kingdom . |

*Primary Examiner*—Edgar Burr
*Assistant Examiner*—Charles H. Nolan, Jr.
*Attorney, Agent, or Firm*—Finnegan, Henderson, Farabow, Garrett & Dunner, L.L.P.

[57] ABSTRACT

An electrical connector is provided for detecting a terminal holder's projecting from a connector housing easily. The electrical connector includes a first connector housing, a second connector housing having a hood for receiving the first connector housing, and the terminal holder. The terminal holder is provided with an engagement groove which abuts on the hood when the first connector housing is engaged with the second connector housing by mistake. Consequently, it is possible to prevent the first connector housing having the terminal incompletely inserted therein from engaging with the second connector housing.

7 Claims, 12 Drawing Sheets

ELECTRICAL CONNECTOR

BACKGROUND OF THE INVENTION

The present invention relates to an electrical connector with detecting means which, in case that one or more terminals are incompletely inserted into terminal accommodating chamber in an connector housing, prevents the connector housing from being engaged with another connector housing.

In general, this kind of electrical connector comprises a male connector housing, a female connector housing for accommodating the male connector housing therein, and a terminal holder to be engaged in the male connector housing.

In operation of the general electrical connector, the terminal holder is firstly inserted into an insertion hole formed in the male connector housing. Then, the inserted terminal holder is temporarily fixed in the male connector housing by an engagement of a temporary engagement projection formed on the terminal holder with a temporary engagement part formed on the male connector housing. Next, under the temporary engagement condition, normally, a plurality of female terminals are inserted into terminal accommodating chambers formed in the male connector housing and secured therein. Thereafter, the terminal holder is further depressed and formally engaged in the male connector housing by an engagement of a formal engagement projection of the terminal holder with a formal engagement part of the male connector housing. Subsequently, the male connector housing is engaged with the female connector housing, whereby the female terminals in the male connector housing can be electrically connected with the male terminals inserted into the female connector housing, finally.

In the conventional connector, however, since the male connector housing includes a great number of terminal accommodating chambers into which the corresponding female terminals are to be inserted, there is a possibility that the female terminals completely and incompletely inserted into the terminal accommodating chambers exist together in the male connector housing. Then, due to a difficulty for a worker to distinguish respective conditions of the female terminals in the terminal accommodating chambers from the outside, if the terminal holder is depressed into the insertion hole by mistake, only one side of the terminal holder may be formally engaged in the male connector housing, depending on the position of the female terminal inserted imperfectly. Or again, the other side of the terminal holder may project from the insertion hole in spite that the terminal holder is accommodated in the insertion hole. Under such a condition, when the male connector housing is forcibly engaged with the female connector housing by mistake, the terminal holder is stuffed into the insertion hole by a hood projecting from the female connector housing, so that the male connector housing may be fitted into the female connector housing under an undesirable condition.

SUMMARY OF THE INVENTION

Under such a circumstance, it is therefore an object of the present invention to provide an electrical connector with detecting means which, in case that one or more terminals are inserted into one connector housing incompletely, allows a worker to detect a terminal holder's projecting from the connector housing with ease when engaging the connector housing with another connector housing to be mated with the former connector housing.

The object of the present invention described above can be accomplished by an electrical connector comprising:

a first connector housing having at least one terminal accommodating chamber formed therein for accommodating a terminal;

a second connector housing having a hood for receiving the first connector housing;

a terminal holder including a frame body with at least one insertion hole formed corresponding to the terminal accommodating chamber, the terminal holder being adapted so as to engage in the first connector housing temporarily and formally thereby to fix the terminal inserted into the terminal accommodating chamber; and detecting means for detecting the terminal holder's projecting from the first connector housing when the terminal is inserted into the terminal accommodating chamber incompletely.

According to the above-mentioned arrangement, while the terminal holder is temporarily engaged in the first connector housing, the terminal is inserted into the terminal accommodating chamber. After insertion, the terminal holder is formally engaged in the first connector housing to fix the terminal in the terminal accommodating chamber. Therefore, if the terminal is inserted into the terminal accommodating chamber incompletely, the terminal holder will project from the first connector housing because the terminal holder is not engaged in the first connector housing formally. Consequently, even if a worker is eager to further engage the first connector housing with the second connector housing by mistake, such a projecting of the terminal holder from the first connector housing can be detected by the detecting means, whereby the first and second connector housings cannot engage with each other.

On the contrary, if the terminal is inserted into the terminal accommodating chamber completely, the terminal holder does not project from the first connector housing since the terminal holder can be engaged in the first connector housing formally. Consequently, the first and second connector housings can engage with each other.

In the present invention, preferably, the detecting means comprises an engagement groove which is formed on one sidewall of the frame body and adapted so as to abut on the hood when the first connector housing is engaged with the second connector housing. With this arrangement, when the first connector housing having the terminal holder imperfectly engaged therein is engaged with the second connector housing by mistake, the engagement groove comes into contact with the hood. Consequently, it is possible to prevent the first connector housing having the terminal incompletely inserted therein from engaging with the second connector housing.

In the present invention, more preferably, the engagement groove has a slanted surface which is inclined from an edge of the sidewall toward a center of the insertion hole in the longitudinal direction. With this arrangement of the slanted surface, when the first connector housing is erroneously engaged with the second connector housing, the slanted of the engagement groove abuts on the hood. With this abutment, an external force in a direction opposite to a direction to insert the terminal holder into the first connector housing acts on the slanted surface, so that the terminal holder is drawn out of the first connector housing by the hood of the second connector housing.

Or again, the detecting means may comprise a slanted projection which is formed on an end wall on an opening side of the hood of the second connector housing so as to project in a direction to engage the second connector housing with the first connector housing and which is formed so as to extend into the hood. With this arrangement of the slanted projection, when the first connector housing is erroneously engaged with the second connector housing, the slanted projection abuts on the frame body of the terminal holder. Consequently, also in this case, the provision of the slanted projection makes it possible to prevent the first connector housing having the terminal incompletely inserted therein from engaging with the second connector housing.

In the above-mentioned arrangement, preferably, the slanted projection is formed so as to project toward the first connector housing which is being engaged with the second connector housing and includes a tapered surface facing toward the terminal holder which is being inserted into the first connector housing. In such a case, when the tapered surface of the slanted projection abuts on the frame body of the terminal holder, the frame body is prevented from entering into the hood due to the hood. Consequently, also in this case, it makes possible to prevent the first connector housing having the terminal incompletely inserted therein from engaging with the second connector housing. Note, although a clearance is produced between an inner wall of the hood of the second connector housing and an outer wall of the first connector housing engaged with the second connector housing, it is a matter of course that the above-mentioned slanted projection is formed so as to extend into the hood within limits of the clearance.

In addition to the slanted projection of the above-mentioned arrangement, the detecting means may further comprise an engagement groove which is formed on the frame body to have a slanted surface and which is adapted so that, when the first connector housing is engaged with the second connector housing, the slanted surface abuts on the tapered surface. Similarly, when the first connector housing is erroneously engaged with the second connector housing, the slanted surface of the engagement groove abuts on the tapered surface of the slanted projection. Consequently, it is possible to prevent the frame body with the engagement groove from entering into the hood having the slanted projection.

Note, through the above-mentioned arrangement, the first connector housing may be a male housing, while the second connector housing is a female connector housing for engagement with the male housing.

These and other objects and features of the present invention will become more fully apparent from the following description and appended claims taken in conjunction with the accompany drawing.

DESCRIPTION OF THE PREFERRED EMBODIMENT

Embodiments of the present invention will be described with reference to drawings. FIGS. 1 to 10 show an electrical connector in accordance with a first embodiment of the present invention.

Figure 1:
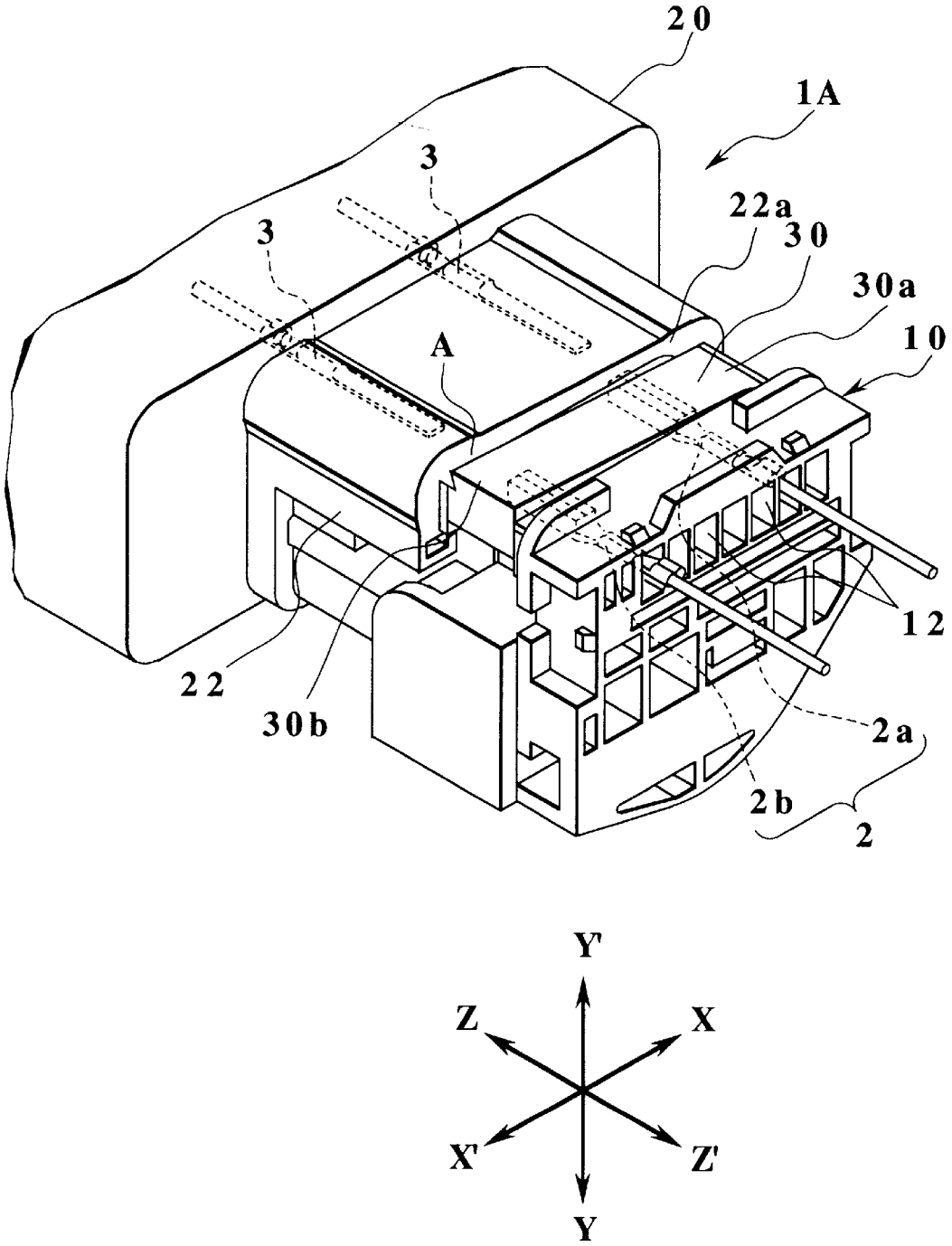
FIG. 1 is a perspective view of an electrical connector with detecting means, in accordance with a first embodiment of the present invention.

In FIG. 1, the electrical connector 1A includes a male connector housing 10, a female connector housing 20, a terminal holder 30 to be inserted into the male connector housing 10 for temporary and formal engagement, and detecting means A for detecting the terminal holder 30 projected from the male connector housing 10. Note, in this specification, the male connector housing 10 and the female connector housing 20 will be referred to "the male housing 10" and "the female housing 20", respectively, hereinafter.

As shown in FIGS. 3 to 7, the male housing 10 has a plurality of terminal accommodating chambers 12 formed inside a housing body 11 and an insertion hole 13 formed on a lower wall 11*a* of the housing body 11 to accept the terminal holder 30 therein. The insertion hole 13 is formed so as to extend across the terminal accommodating chambers 12. The housing body 11 is provided, on a left sidewall 11*b* thereof, with an introduction port 13*a* for introducing into the insertion hole 13. Further formed on the left sidewall 11*b* through the intermediary of a tapered surface 14*a* is a temporary engagement hole 14 above which a formal engagement piece 15*a* is provided. Additionally, a guide groove 16 is formed to extend along the insertion hole 13. On the other hand, another formal engagement piece 15*b* is formed on a right sidewall 11*c* of the body 11. Reference numeral 19 designates a slide member which serves the male housing 10 with the female housing 20 while allowing the former to be fitted to the latter. Note, the configuration of the male housing 10 is at the option of the application so long as it can engage with the terminal holder 30 temporarily and formally and have the female terminals 2*a* fixed therein. Again, there is not necessarily need to provide the slide member 19 in the male housing 10.

Figure 8:
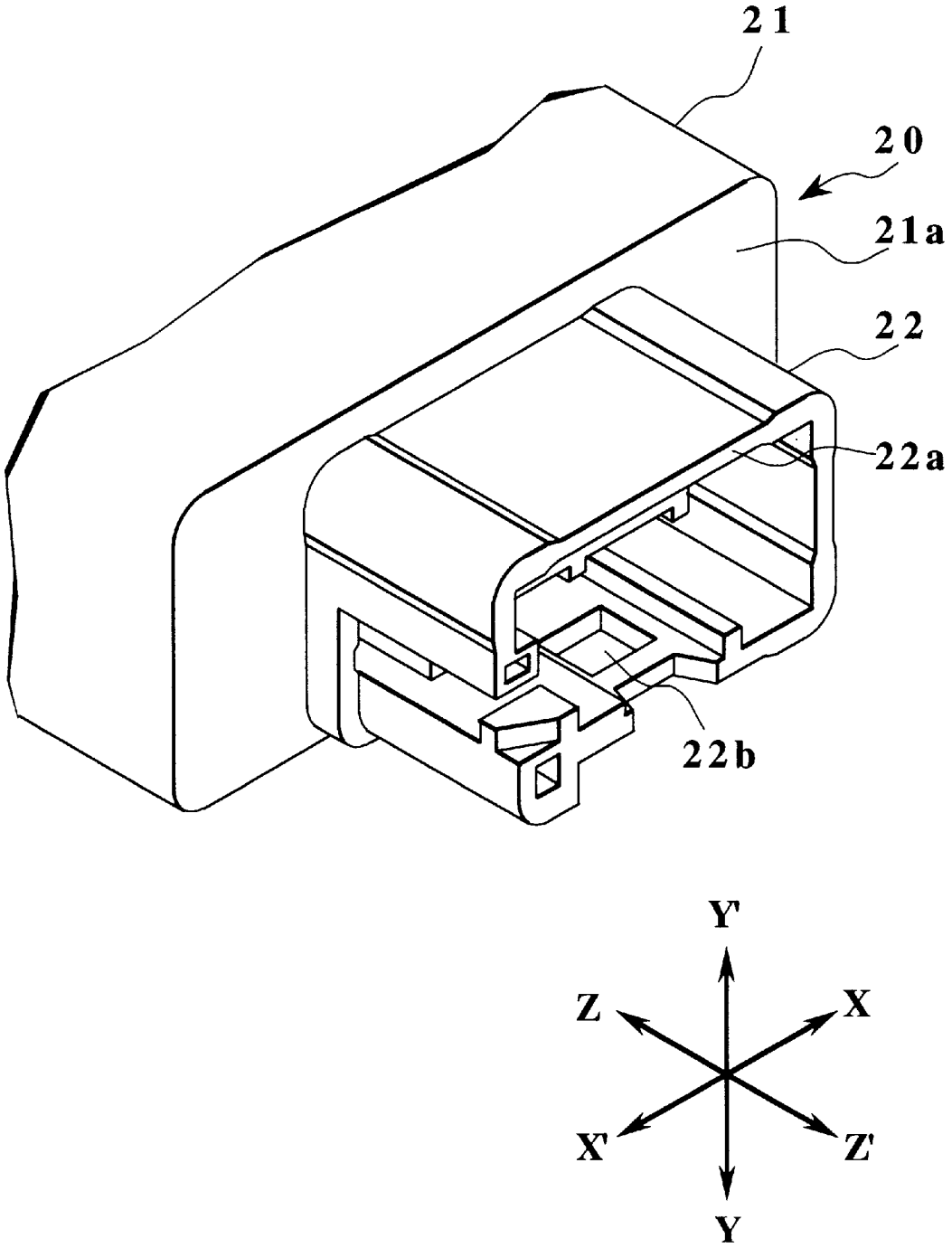
FIG. 8 is a perspective view of a female housing constituting the electrical connector of the embodiment.

As shown in FIG. 8, the female housing 20 is provided, on a front wall 21*a* of a housing body 20, with a hood 22 for accommodating the male housing 10. The female housing 20 has a plurality of terminal accommodating chambers (not shown) formed inside the housing body 21, for accommodating a plurality of male terminals 3 (see FIG. 1). The male terminals 3 inserted into the terminal accommodating chambers are arranged so as to extend from the front wall 21*a* into the hood 22. Note, in a modification, a connector directly connected with an instrument may be adopted as the female housing 20.

Figure 2:
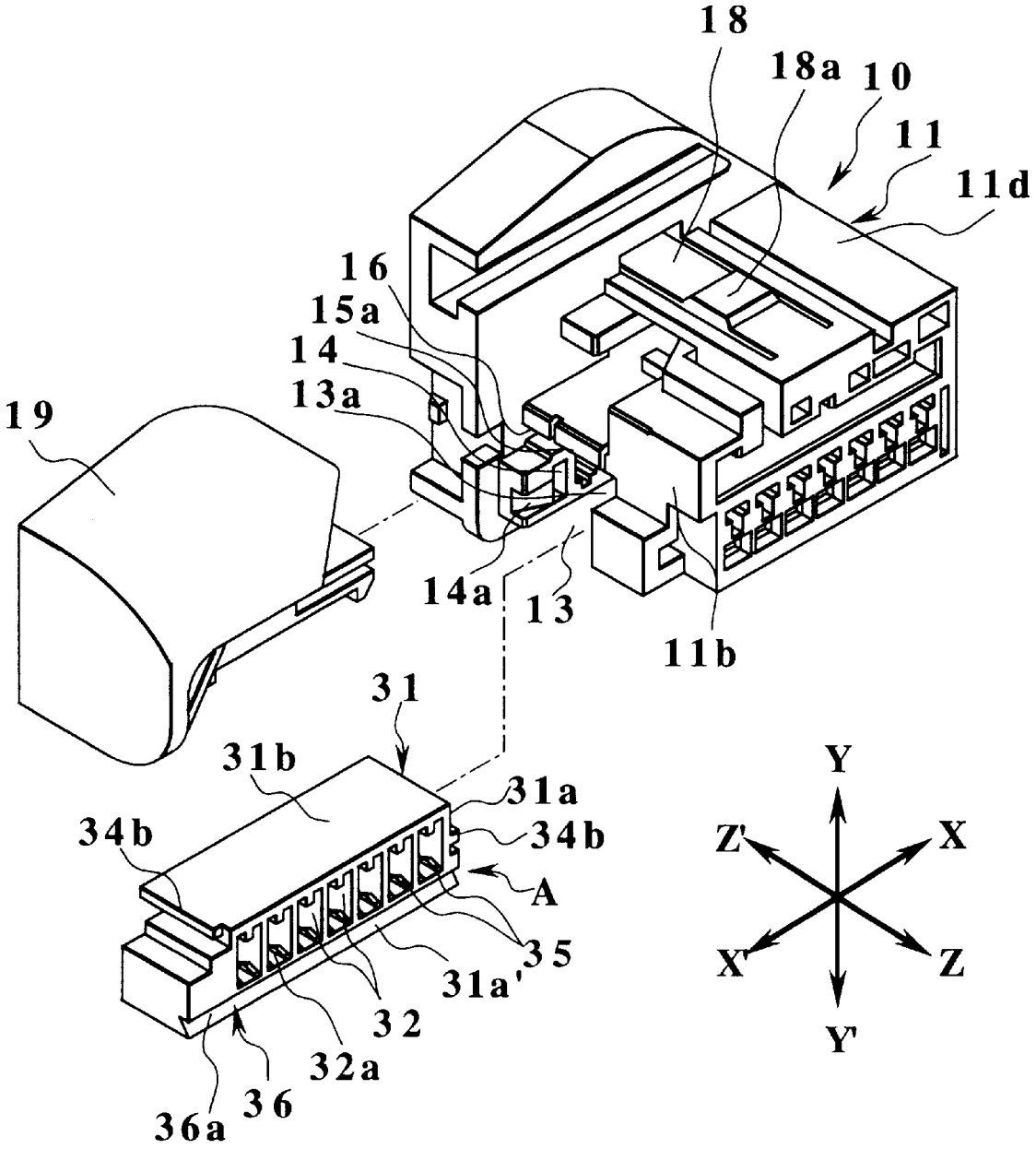
FIG. 2 is a perspective view of a male housing and a terminal holder together constituting the electrical connector of FIG. 1.
Figure 3:
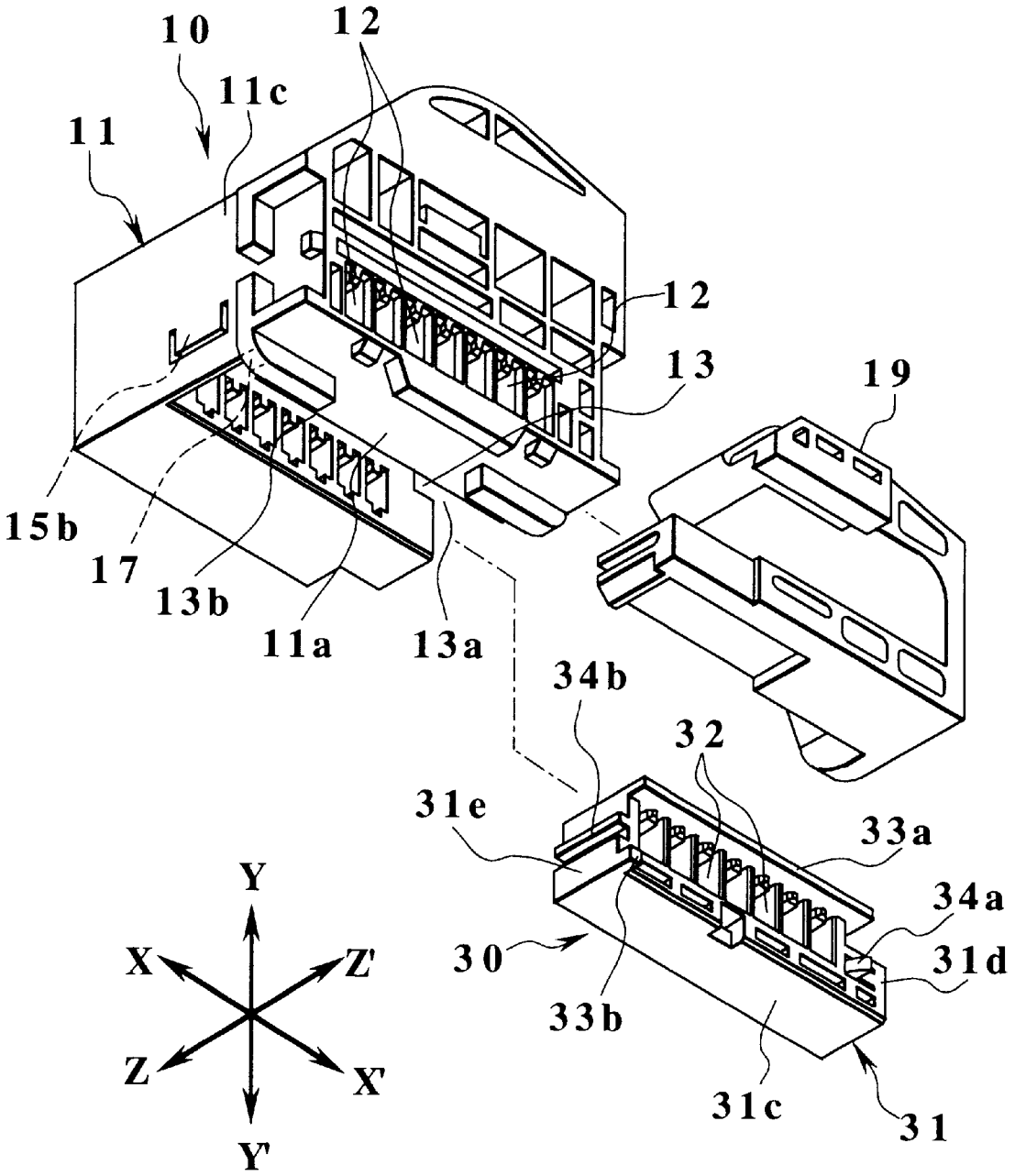
FIG. 3 is a view of FIG. 2, viewed from a direction of Y of FIG. 2.
Figure 4:
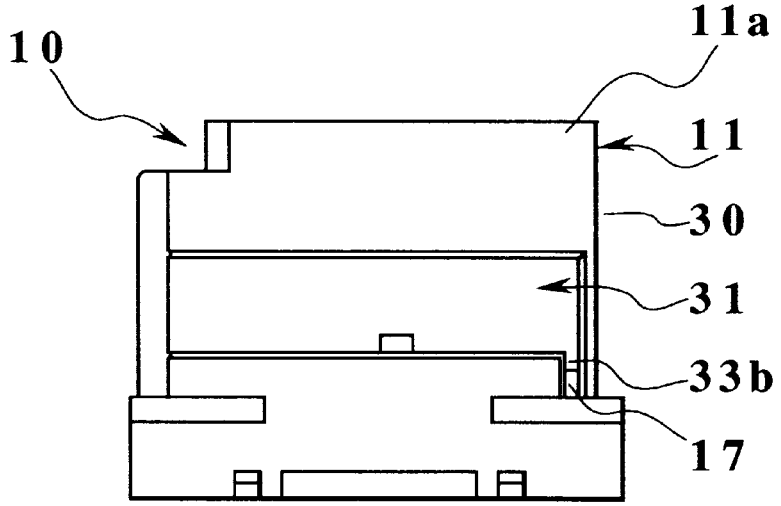
FIG. 4 is a bottom view of showing a condition that the terminal holder is engaged in the male housing.
Figure 5:
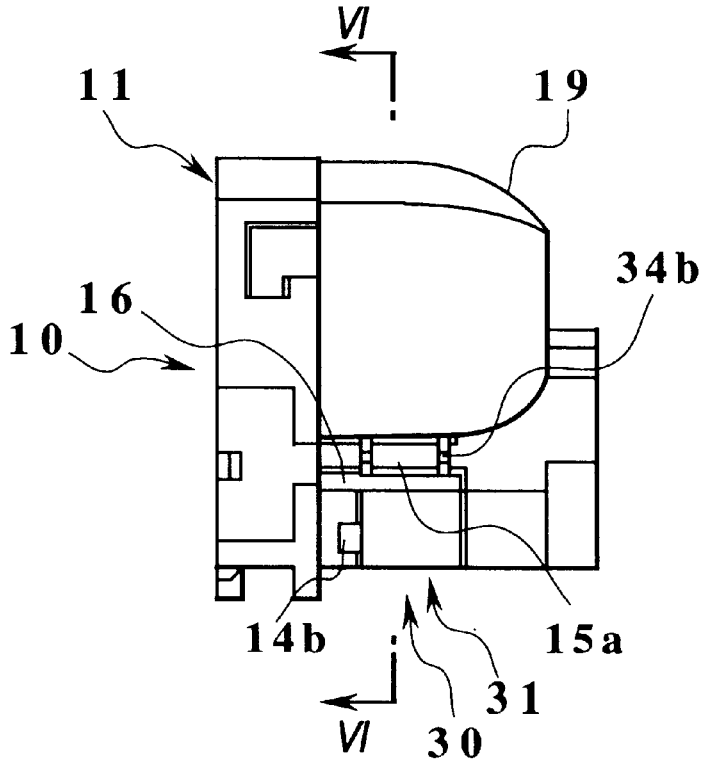
FIG. 5 is a left side view of FIG. 4.
Figure 6:
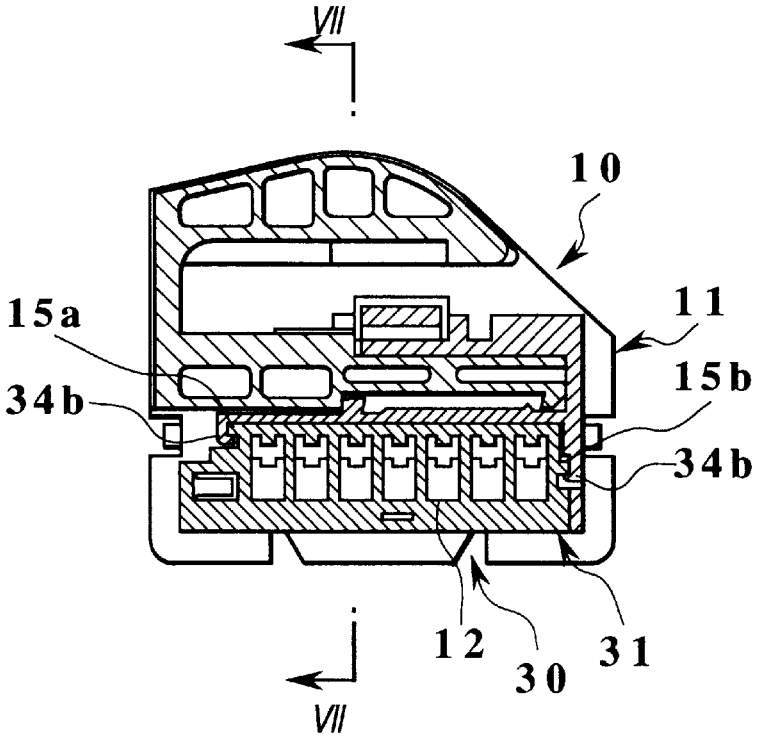
FIG. 6 is a cross sectional view of the electrical connector, taken along a line VI—VI of FIG. 5.
Figure 7:
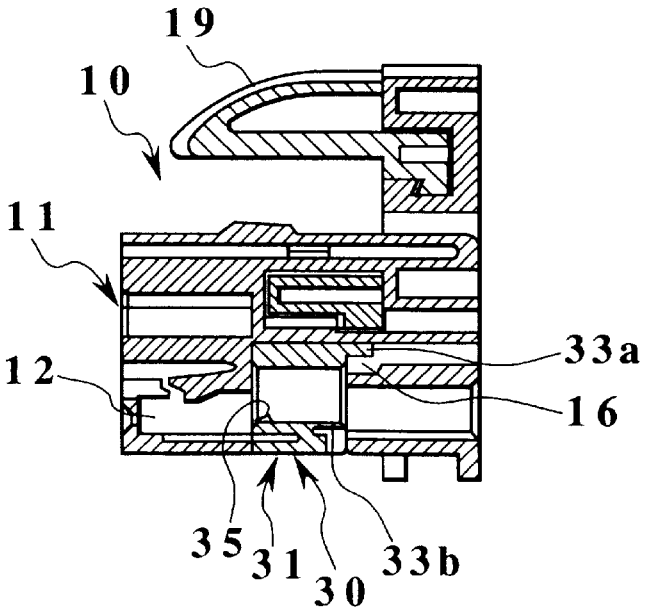
FIG. 7 is a cross sectional view of the electrical connector, taken along a line VII—VII of FIG. 6.

As shown in FIGS. 2 and 3, the holder 30 is constituted by a frame body 31 in the form of a lattice, which includes insertion holes 33 corresponding to the terminal accommodating chambers 12 of the male housing 10, respectively. Further, the frame body 21 is provided, on a lower side of a front wall 31*a* thereof, with detecting means A described later. The frame body 21 has a guide rail 33*a* formed on an upper wall 31*b* and a guide projection 33*b* formed on a lower wall 31*c*. The guide rail 33*a* and the guide projection 33*b* are formed in parallel with each other. On a rear wall 31*d* of the frame body 31, a flexible temporary engagement projection 34*a* is formed so as to extend in the same direction of the guide projection 33*b*. On the other hand, a streak of formal engagement projection 34*b* is provided on a right sidewall 31*e* of the frame body 31. Each insertion hole 32 has a terminal pusher 35 formed on a bottom wall 32*a*, for engagement with the female terminal 2 inserted into the male housing 10.

Figure 10:
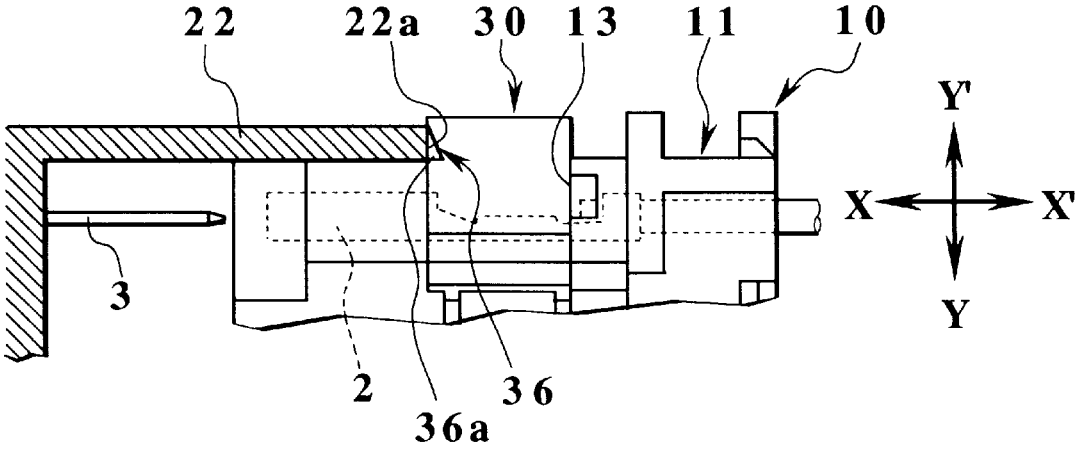
FIG. 10 is a view showing a condition that an engagement groove of the terminal holder abuts on a hood of the female housing, the engagement groove projecting from the male housing.

The above-mentioned detecting means A comprises an engagement groove 36 which is formed on the lower side of the front wall 31*a* of the frame body 31 so as to extend in the longitudinal direction of the body 31. The engagement groove 36 has a slanted surface 36*a* formed to extend from a lower edge 31*a*' of the front wall 31*a* toward respective centers of the insertion holes 32 in the longitudinal direction, i.e., obliquely upward. In this way, owing to the formation of the engagement groove 36 on the front wall 31*a* of the frame body 31, in case that the terminal holder 30 projects from the insertion hole 13 and even if the male and female housings 10, 20 are mutually engaged with each other by mistake, the slanted surface 36*a* of the groove 36 can abut on the front wall 22*a* of the hood 22, as shown in FIG. 10. Consequently, without being accommodated in the hood 22, the male housing 10 is prevented from engaging with the female housing 20.

We now describe how to detect a condition that one or more female terminals are incompletely inserted into the male housing 10 by using the detecting means A.

First of all, as shown in FIGS. 2 and 3, when the terminal holder 30 is forced to the interior of the insertion hole 13 through the introduction port hole 13*a* (i.e. the direction of X), the guide rail 33*a* is conducted into the guide groove 16, while the guide projection 33*b* is slidably moved on the lower wall 11*a* of the housing body 11 along an opening 13*b* of the insertion hole 13. Then, the guide projection 33*b* is engaged in the guide hole 17 formed on the lower wall 11*a* and the temporary engagement projection 34*a* is guided by the tapered surface 14*a* and engaged in the temporary engagement hole 14, so that the terminal holder 30 is engaged in the male housing 10 temporarily. Under such a temporary engagement condition, the female terminals 2 are inserted into the terminal accommodating chambers 12 in the direction of Z.

Hereat, since the great number of female terminals 2 are inserted into the great number of terminal accommodating chambers 12 of the male housing 10 as shown in FIG. 1, there is a case where the female terminals 2*b* perfectly and imperfectly inserted into the terminal accommodating chambers 12 exist in confusion. However, due to a difficulty for a worker to distinguish such inserted conditions of the female terminals 2 in the terminal accommodating chambers 12 from the outside, the terminal holder 30 will be depressed into the insertion hole 13 after inserting the female terminals 2. Consequently, depending on the position of the female terminal 2*b* incompletely inserted into the terminal accommodating chamber 12, either one of the formal engagement projections 34*b* on both sides of the terminal holder 30 may engage with the formal engagement piece 15*a* (or 15*b*) on the housing body 11, in other words, the only side 30*a* of the terminal holder 30 may be formally engaged with the male housing 10 or accommodated in the insertion hole 13 for some reason or other. Note, such a condition of the connector will be referred as "a condition M", hereinafter.

Under the above condition M, as shown in FIG. 10, when the male housing 10 is engaged with the female housing 20 by mistake, the tapered surface 36*a* of the engagement groove 36 abuts on the front wall 22*a* of the hood 22. With this abutment, an external force in an opposite direction of Y' to a direction to depress the holder 30 acts on the tapered surface 36*a* through the front wall 22*a*, so that the terminal holder 30 is drawn out in the direction of Y'. Consequently, the more it is desired to engage the male and female housings 10, 20 with each other, the more the terminal holder 30 is drawn out, thereby making it possible for the worker to distinguish the holder 30 projecting from the insertion hole 13 visually. Accordingly, it is possible to detect such a condition that the female terminal 2 is inserted into the terminal accommodating chamber 12 of the male housing 10 incompletely easily and certainly.

Note, in case that the female terminal 2 is perfectly inserted into the terminal accommodating chamber 12 of the male housing 10, as shown in FIGS. 2 to 5, both sides 30*a*, 30*b* of the terminal holder 30 can be inserted into the insertion hole 13 by the respective engagement of the formal engagement projections 34*b* on both sides of the terminal holder 30 inserted into the insertion hole 13 with the formal engagement pieces 15*a*, 15*b* on both sides of the housing body 11, whereby the holder 30 does not project from the insertion hole 13. Note, this condition will be referred as "a condition N", hereinafter.

Therefore, the male housing 10 can be accommodated in the hood 22 since the tapered surface 36*a* of the engagement groove 36 does not abut on the front wall 22*a* of the hood 22, so that a locking projection 18*a* formed on a locking arm 18 engages in a locking hole 22*b* formed in the hood 22. In this way, the male and female housings 10, 20 can be mutually fitted to each other, so that the female terminals 2 in the male housing 10 are electrically connected with the male terminals 3 in the female housing 20. Thereafter, in the direction of X, the slide member 19 is slid and fixed on the male housing 10 while allowing the fitting condition between the male housing 10 and the female housing 20 to be confirmed.

Figure 11:
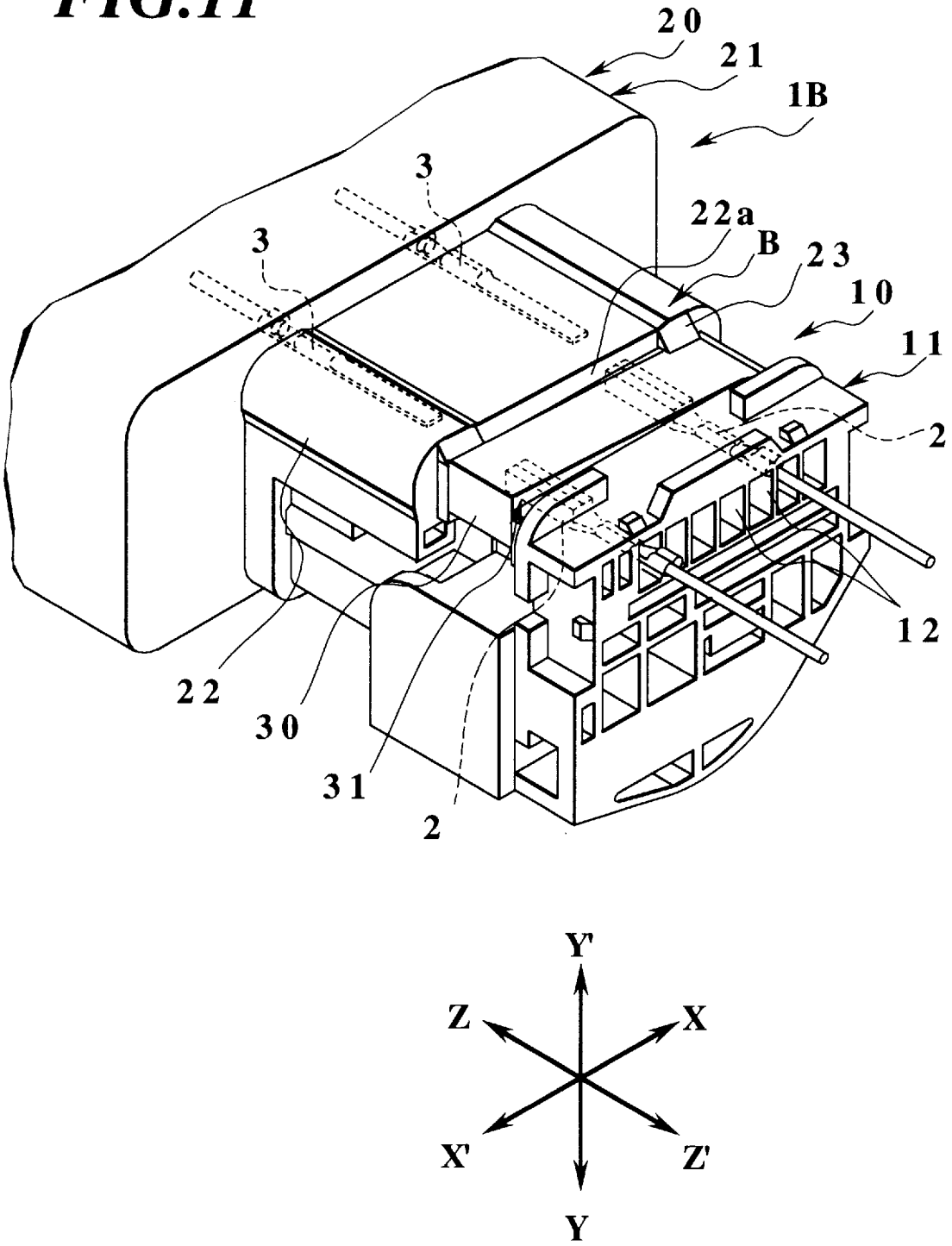
FIG. 11 is a perspective view of an electrical connector with detecting means, in accordance with a second embodiment of the present invention.
Figure 12:
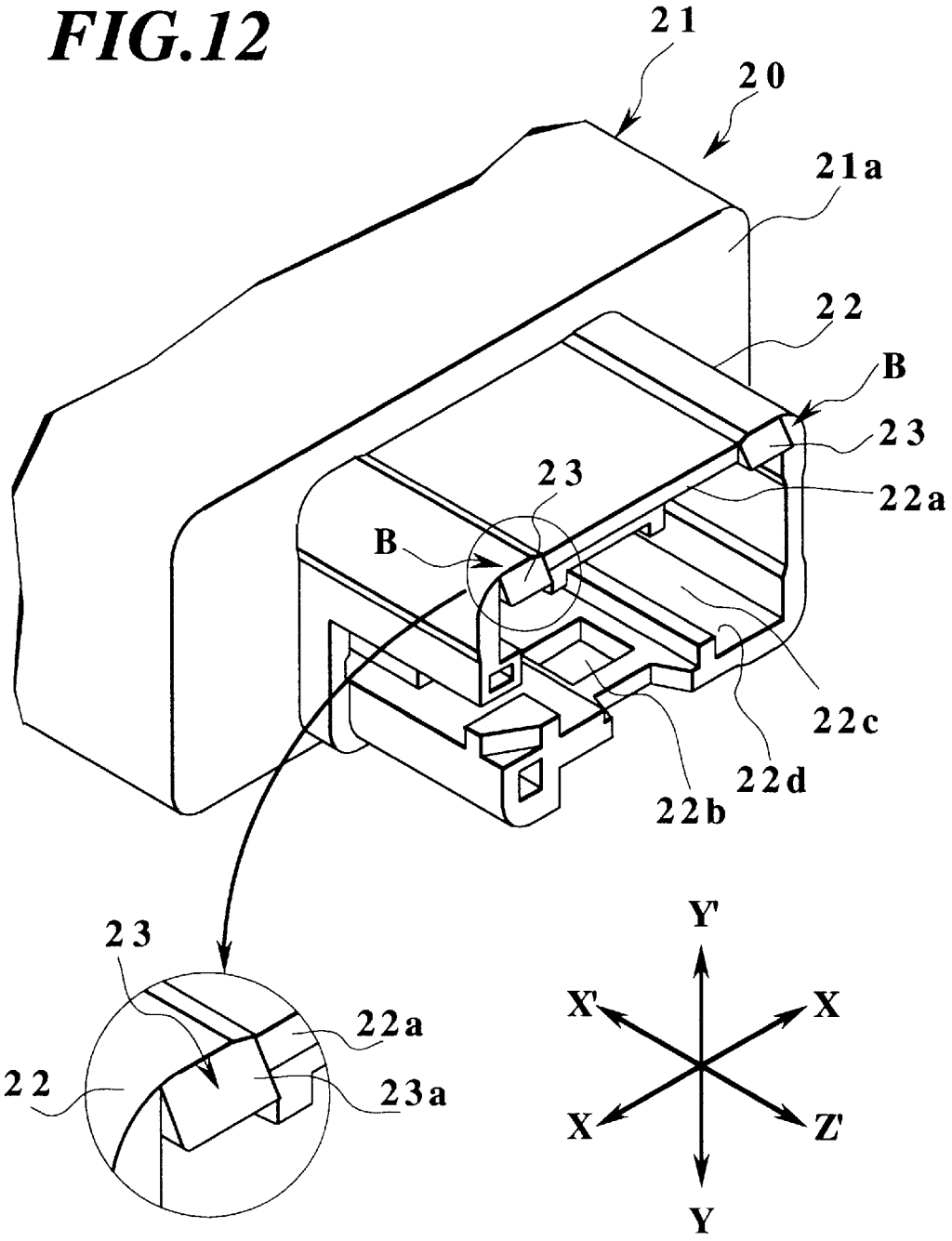
FIG. 12 is a perspective view of a male housing constituting the electrical connector of FIG. 11.
Figure 13:
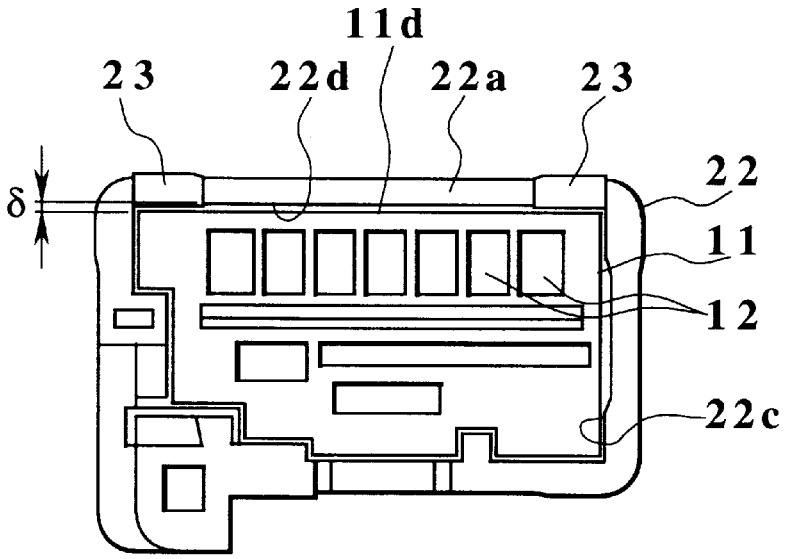
FIG. 13 is a view showing a clearance between the male housing and a hood of a female housing.

FIGS. 11 to 13 show the second embodiment of the electrical connector with detecting means B. Note, in this embodiment, elements similar to those of the first embodiment are indicated with the same reference numerals, respectively and their overlapping descriptions are eliminated.

In FIGS. 11 and 12, this detecting means B is constituted by slanted projections 23 each of which is formed on the front wall 22*a* on the side of an opening 22*c* of the hood 22 projecting from the housing body 21 and which projects in the direction of Z' opposite to the direction Z and extends into the hood 22.

As shown in FIG. 13, it should be noted that, under the engaging condition of the male and female housings 10, 20, there exists a clearance δ between an inner wall 22*d* of the hood 22 and a peripheral wall 11*d* of the housing body 11. Thus, the slanted projections 23 are formed so as to extend into the hood 22 within the limits of the clearance δ. Further, the slanted projections 23 are arranged on both sides of the front wall 22*a* so as to oppose the terminal holder 30 at the engagement of the male and female housings 10, 20. Each projection 23 includes a tapered surface 23*a* extending to the direction of Z'. Note, it may be applicable to form the slanted surface 23 in the longitudinal direction of the front wall 22*a* continuously.

Figure 14:
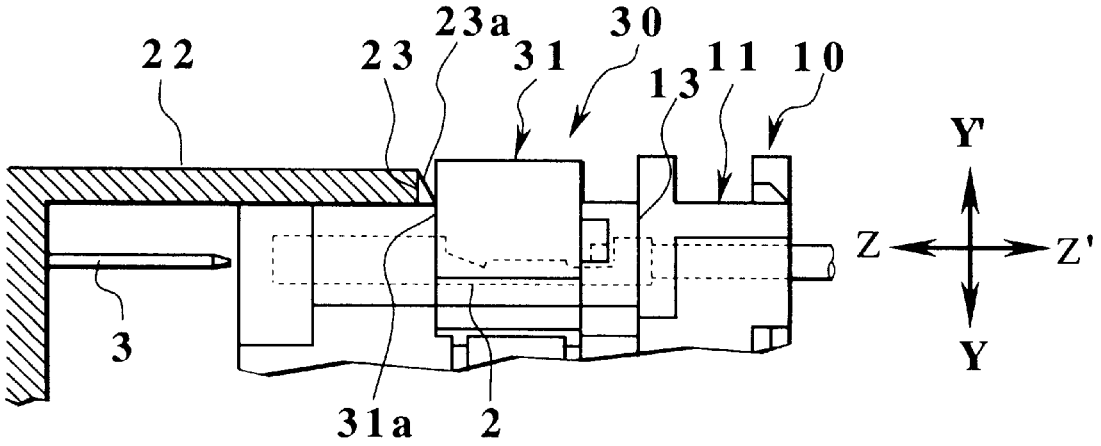
FIG. 14 is a view showing a condition that a slanted projection formed on the hood abuts on a terminal holder projecting from the male housing.

In this way, owing to the formation of the slanted projections 23 with the tapered surfaces 23*a* on the front wall 22*a* of the hood 22, in case that the terminal holder 30 projects from the insertion hole 13 and even if the male and female housings 10, 20 are mutually engaged with each other by mistake, the tapered surfaces 23*a* of the slanted projections 23 abut on the frame body 31 of the holder 30, as shown in FIG. 14. Consequently, without being accommodated in the hood 22, the male housing 10 is prevented from engaging with the female housing 20.

We now describe how to detect a condition that one or more female terminals are incompletely inserted into the male housing 10 by using the detecting means B.

Under the above condition M, when the male housing 10 is engaged with the female housing 20 by mistake, the tapered surfaces 23*a* of the slanted projections 23 abut on the front wall 31*a* of the frame body 31. With this abutment, the front wall 31*a* of the frame body 31 begins to move along the tapered surfaces 23*a* to the direction of Y', so that the terminal holder 30 is drawn out in the direction of Y'. Consequently, the more the worker is eager to engage the male and female housings 10, 20 with each other, the more the terminal holder 30 is drawn out, thereby making it possible for the worker to distinguish the holder 30 projecting from the insertion hole 13 visually. Accordingly, it is possible to easily and certainly detect the case where the female terminal 2 inserted into the terminal accommodating chamber 12 of the male housing 10 is on the incompletely inserted condition.

It is noted that, under the condition N, the tapered surfaces 23*a* of the slanted projections 23 do not abut on the front wall 31*a* of the frame body 31, so that the male housing 10 is accommodated in the hood 22, while the locking projection 18*a* of the locking arm 18 engages in the locking hole 22*b* formed in the hood 22. In this way, the male and female housings 10, 20 can be mutually fitted to each other, so that the female terminals 2 in the male housing 10 are electrically connected with the male terminals 3 in the female housing 20. Thereafter, the slide member 19 of the male housing 10 is slid in the direction of X, whereby the engagement condition between the male housing 10 and the female housing 20 is stabilized.

Figure 15:
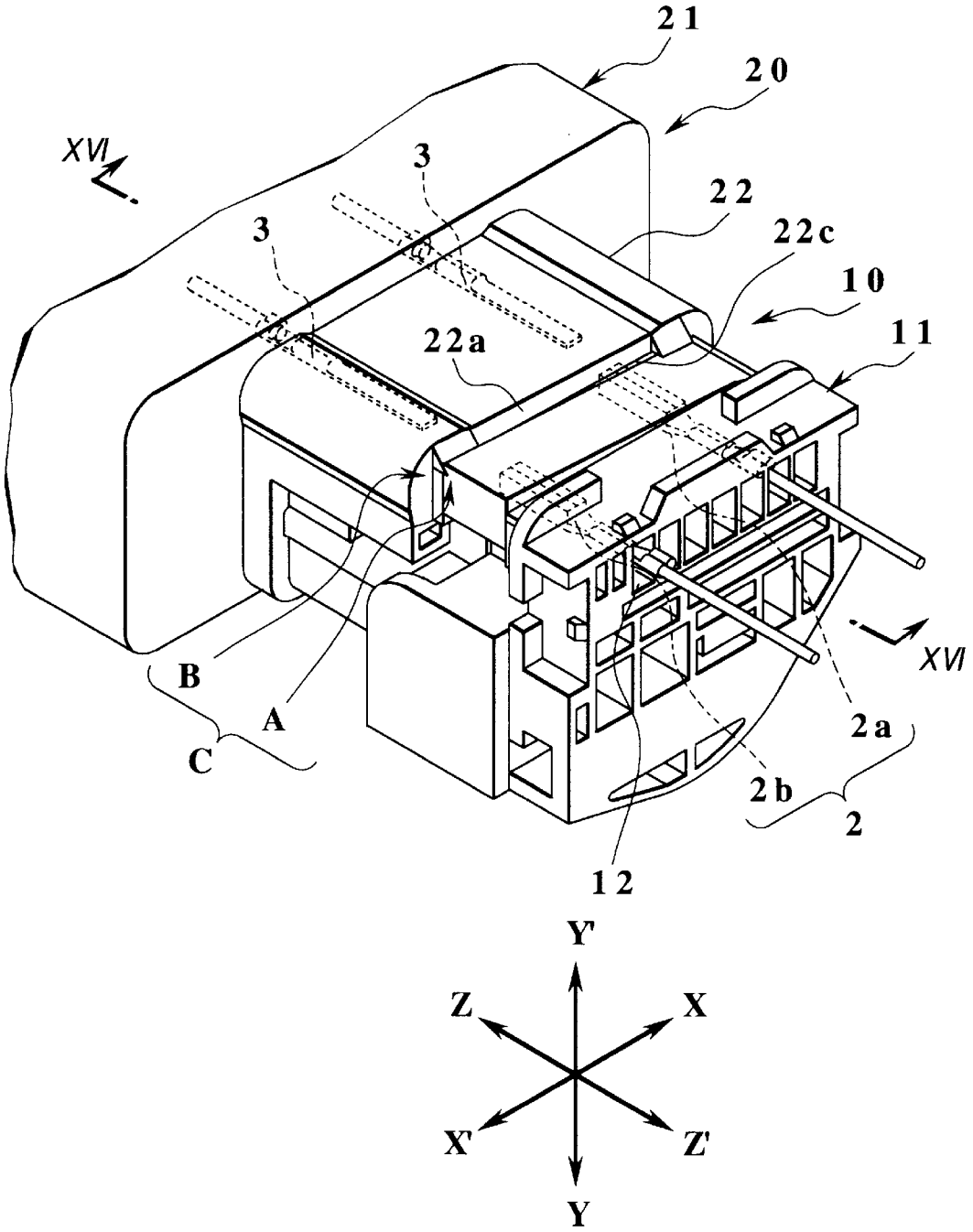
FIG. 15 is a perspective view of an electrical connector with detecting means, in accordance with a third embodiment of the present invention.
Figure 16:
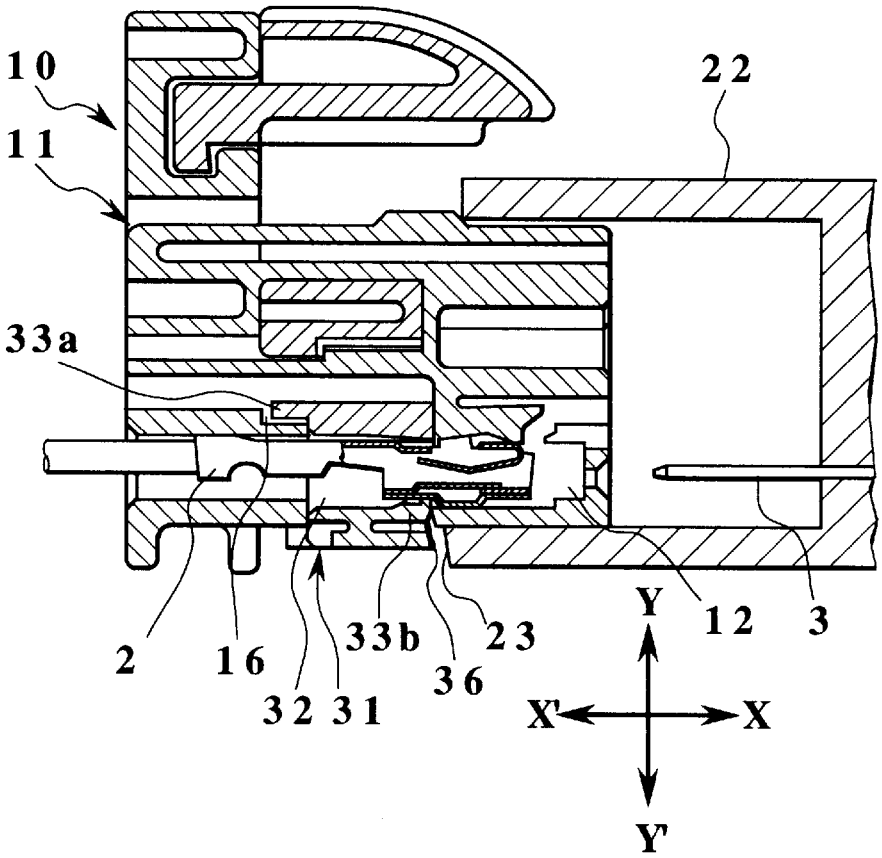
FIG. 16 is a cross sectional view of the electrical connector, taken along a line XVI—XVI of FIG. 15.
Figure 17:
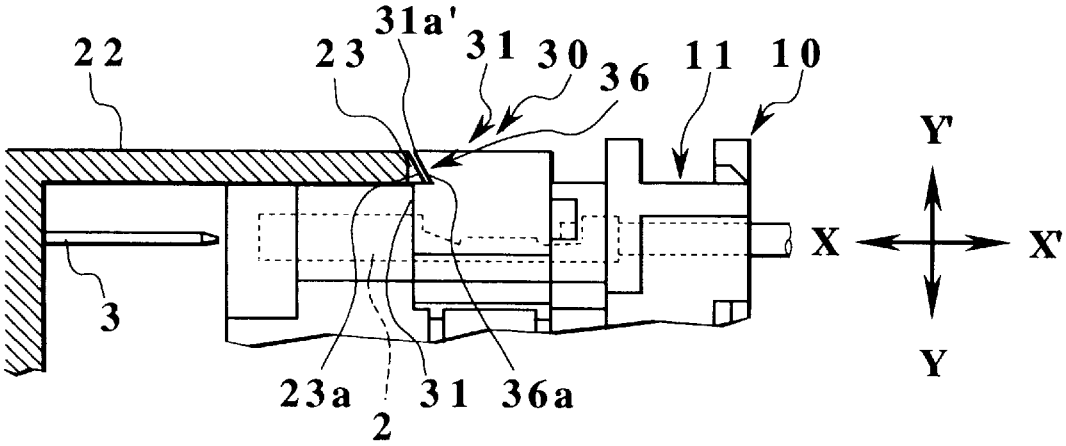
FIG. 17 is a view showing a condition that an engagement groove projecting from a male housing of the electrical connector of FIG. 15 abuts on a slanted projection of a hood of a female housing.

FIGS. 15 and 16 show the third embodiment of the electrical connector with detecting means C. Note, also in this embodiment, elements similar to those of the first and second embodiments are indicated with the same reference numerals, respectively and their overlapping descriptions are eliminated.

In FIGS. 15 and 16, the detecting means C is composed of the above-mentioned detecting means A of the first embodiment and the detecting means B of the second embodiment. That is, the detecting means C comprises the engagement groove 36 (see FIG. 9) formed on the underside of the front wall 31*a* of the frame body 31 to extend in the longitudinal direction and the slanted projections 23 formed on the front wall 22*a* on the side of the opening 22*c* of the hood 22 so as to project in the direction of Z' and extends into the hood 22.

Figure 9:
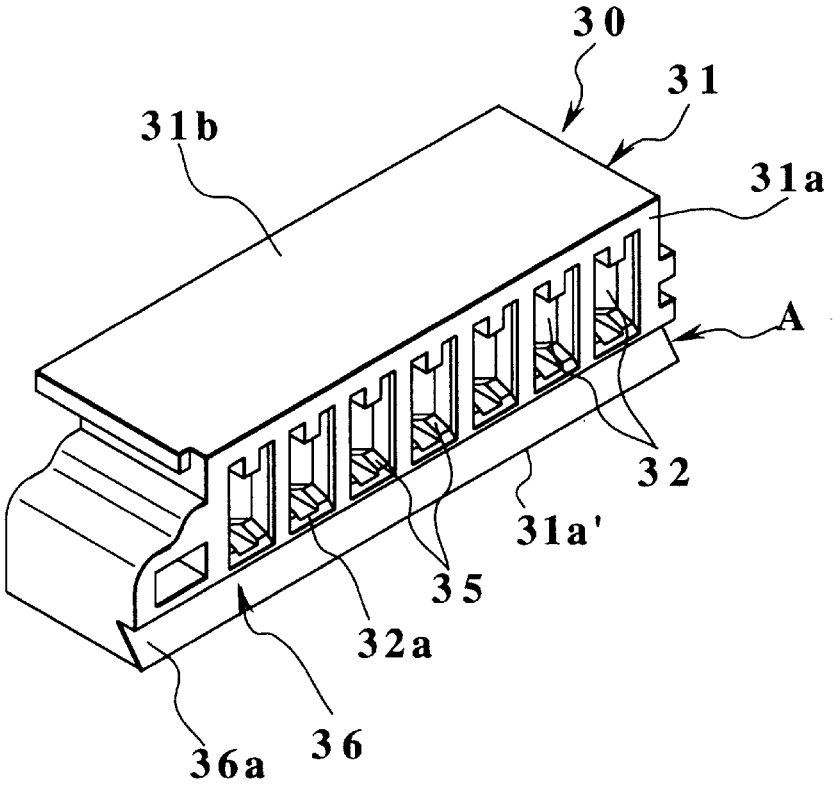
FIG. 9 is an elongated perspective view of the terminal holder of the electrical connector of the embodiment.

As shown in FIG. 9, the engagement groove 36 is provided with the slanted surface 36*a* which directs obliquely upward from the lower edge 31*a*' of the front wall 31*a*.

While, as shown in FIG. 12, the slanted projections 23 are arranged on both sides of the front wall 22*a* so as to oppose the terminal holder 30 at the engagement of the male and female housings 10, 20. Similarly, each of the projections 23 includes the tapered surface 23*a* extending to the direction of Z'. Note, it is preferable that an inclination angle of the slanted surface 36*a* is equal to that of each tapered surface 23*a*.

In this way, since the engagement groove 36 having the slanted surface 36*a* is formed on the front wall 31*a* of the frame body 31 in the direction of Z while the slanted projections 23 having the tapered surfaces 23*a* are formed on the front wall 22*a* of the hood 22 in the direction of Z', in case that the terminal holder 30 projects from the insertion hole 13 and even if the male and female housings 10, 20 are mutually engaged with each other by mistake, the tapered surfaces 23*a* of the slanted projections 23 come into contact with the slanted surface 36*a* of the engagement groove 36. Consequently, without being accommodated in the hood 22, the male housing 10 is prevented from engaging with the female housing 20.

We now describe how to detect a condition that one or more female terminals 2 are incompletely inserted into the male housing 10 by using the detecting means C.

Under the above condition M, when the male housing 10 is engaged with the female housing 20 by mistake, the slanted surface 36*a* of the engagement groove 36 abuts on the tapered surfaces 23*a* of the slanted projections 23. By the abutment, the terminal holder 30 begins to move along the tapered surfaces 23*a* to the direction of Y' and is drawn out in the same direction. Consequently, the more the worker is eager to engage the male housing 10 with the female housing 20, the more the terminal holder 30 is drawn out, thereby making it possible for the worker to distinguish the holder 30 projecting from the insertion hole 13 visually.

Accordingly, it is possible to detect such a condition that the female terminal 2 is incompletely inserted into the terminal accommodating chamber 12 of the male housing 10, easily and certainly. In addition, if the inclination angle of the slanted surface 36*a* is equal to that of each tapered surface 23*a*, the surface 36*a* can stick to the tapered surfaces 23*a*, whereby the engagement between the male and female housings 10, 20 is further prevented.

Similarly, under the condition N, the slanted surface 36*a* of the engagement groove 36 do not abut on the tapered surfaces 23*a* of the slanted projections 23, so that the male housing 10 is accommodated in the hood 22, while the locking projection 18*a* of the locking arm 18 engages in the locking hole 22*b* formed in the hood 22. In this way, the male and female housings 10, 20 can be mutually fitted to each other, so that the female terminals 2 in the male housing 10 are electrically connected with the male terminals 3 in the female housing 20. Thereafter, the slide member 19 of the male housing 10 is slid in the direction of X, whereby the engagement condition between the male housing 10 and the female housing 20 is stabilized.

Therefore, by examining whether the holder 30 is projected by depressing the male housing 10 into the female housing 20, it is possible to distinguish whether the connector is under the condition of M or N, instantly. Thus, it is possible to carry out the fitting operation between the male housing 10 and the female housing 20 rapidly and precisely.

In common with the above-mentioned embodiments, it will be understood that the electrical connector is constructed in a manner that, even if the terminal holder 30 inserted into the male housing 10 is not formally engaged at al, the terminal holder 30 does not project since one side of the holder 30 is inserted into the male housing 10. However, the present invention is applicable for a situation that the other side of the terminal holder 30 projects, of course.

Finally, it will be understood by those skilled in the art that the foregoing description is related to some preferred embodiments of the disclosed electrical connector, and that various changes and modifications may be made to the present invention without departing from the spirit and scope thereof.

What is claimed is:

1. An electrical connector comprising:

a first, male connector housing having at least one terminal accommodating chamber formed therein for accommodating a terminal;

a female connector housing having a hood for receiving said male connector housing;

a terminal holder including a frame body having at least one insertion hole for receiving a terminal and corresponding to said terminal accommodating chamber, said terminal holder being adapted so as to engage in said male connector housing temporarily and formally thereby to fix said terminal inserted into said terminal accommodating chamber, said terminal holder coming into contact with the terminal to project from said male connector housing when said terminal is inserted into said terminal accommodating chamber incompletely; and detecting means for detecting said terminal holder's projecting from said male connector housing when said terminal is inserted into said terminal accommodating chamber incompletely.

2. An electrical connector as claimed in claim 1, wherein said detecting means comprises an engagement groove which is formed on one sidewall of said frame body and adapted so as to abut on said hood when said male connector housing is engaged with said female connector housing.

3. An electrical connector as claimed in claim 2, wherein said engagement groove has a slanted surface which is inclined from an edge of said sidewall toward a center of said insertion hole in a longitudinal direction thereof.

4. An electrical connector as claimed in claim 1, wherein said detecting means comprises a slanted projection which is formed on an end wall on an opening side of said hood of said female connector housing so as to project in a direction to engage said female connector housing with said male connector housing and which is formed so as to extend into said hood, whereby said slanted projection abuts on one sidewall of said frame body when said male connector housing is engaged with said female connector housing.

5. An electrical connector as claimed in claim 4, wherein said slanted projection is formed so as to project toward said male connector housing which is being engaged with said female connector housing and wherein said slanted projection includes a tapered surface facing toward said terminal holder which is being inserted into said male connector housing.

6. An electrical connector as claimed in claim 5, wherein a clearance is produced between an inner wall of said hood of said female connector housing and an outer wall of said male connector housing engaged with said female connector housing, and wherein said slanted projection is formed so as to extend into said hood within limits of said clearance.

7. An electrical connector as claimed in claim 5, wherein said detecting means further comprises an engagement groove which is formed on said frame body to have a slanted surface and which is adapted so that, when said male connector housing is engaged with said female connector housing, said slanted surface abuts on said tapered surface.

* * * * *